US005288023A

United States Patent [19]

Han et al.

[11] Patent Number: 5,288,023

[45] Date of Patent: Feb. 22, 1994

[54] OVER-CENTER BIASING SPRING FOR PART CIRCLE GEAR DRIVEN ROTARY IRRIGATION SPRINKLERS

[75] Inventors: Joseph U. Han, Rancho Cucamonga; Gerald E. Peterson, Riverside, both of Calif.

[73] Assignee: Anthony Manufacturing Corp., Azusa, Calif.

[21] Appl. No.: 964,425

[22] Filed: Oct. 21, 1991

[51] Int. Cl.[5] ..... B05B 3/16

[52] U.S. Cl. ..... 239/242; 239/237

[58] Field of Search ..... 239/242, 240, 237, 206, 239/205; 267/158, 165, 164, 107, 108; 74/97.2, 100.2

[56] References Cited

U.S. PATENT DOCUMENTS

| | | | |
|---|---|---|---|
| 1,331,677 | 2/1920 | Schachter | 267/165 |
| 1,893,098 | 1/1933 | Murray, Sr. et al. | 267/165 |
| 2,448,230 | 8/1948 | Miller | 74/97.2 |
| 2,462,244 | 2/1949 | Wise | 74/97.2 |
| 2,773,145 | 12/1956 | Immel | 74/100.2 |
| 3,107,056 | 10/1963 | Hunter | 239/242 |
| 3,713,584 | 1/1973 | Hunter | 239/206 |
| 3,724,757 | 4/1973 | Hunter | 239/205 |
| 4,568,024 | 2/1986 | Hunter | 239/242 |
| 4,708,291 | 11/1987 | Grundy | 239/242 |
| 4,718,605 | 1/1988 | Hunter | 239/242 |
| 4,773,595 | 9/1988 | Livne | 239/242 |
| 4,901,924 | 2/1990 | Kah, Jr. | 239/242 |
| 4,948,052 | 8/1990 | Hunter | 239/242 |
| 4,955,542 | 9/1990 | Kah, Jr. | 239/242 |
| 5,086,977 | 2/1992 | Kah, Jr. | 239/206 |

FOREIGN PATENT DOCUMENTS

| | | | |
|---|---|---|---|
| 1206147 | 2/1960 | France | 267/108 |
| 348009 | 9/1960 | Switzerland | 267/165 |

*Primary Examiner*—Karen B. Merritt

*Attorney, Agent, or Firm*—Kelly, Bauersfeld & Lowry

[57] ABSTRACT

An Omega type biasing spring for use in a part circle gear driven sprinkler of the type having a reversing gear train mounted on a pivotal yoke and operated by a lost motion trip mechanism, the omega spring having a bulbous-shaped arcuate head section interconnected with laterally diverging leg sections through a narrow neck section defining a lateral gap which closes upon spring compression to reduce internal spring stress.

10 Claims, 2 Drawing Sheets

FIG. 4
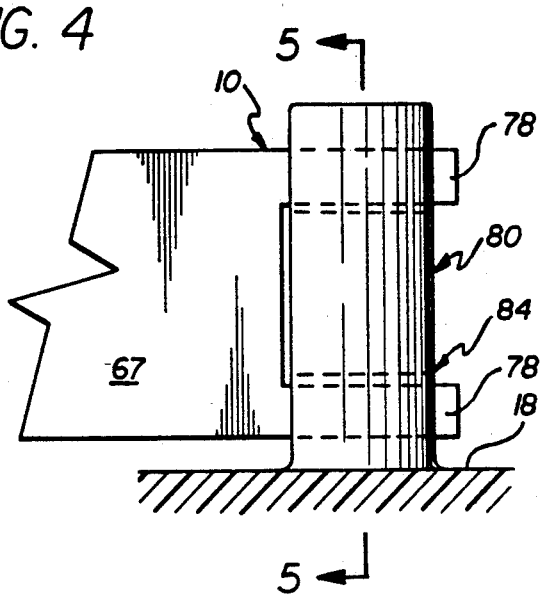
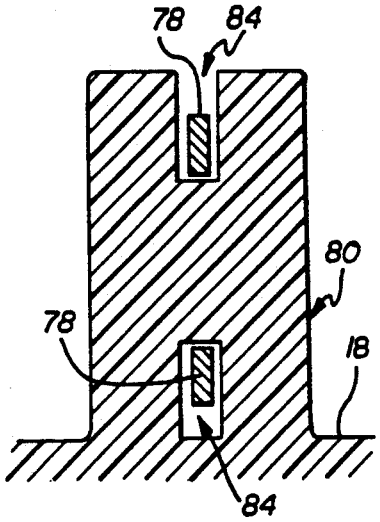
FIG. 6
FIG. 6
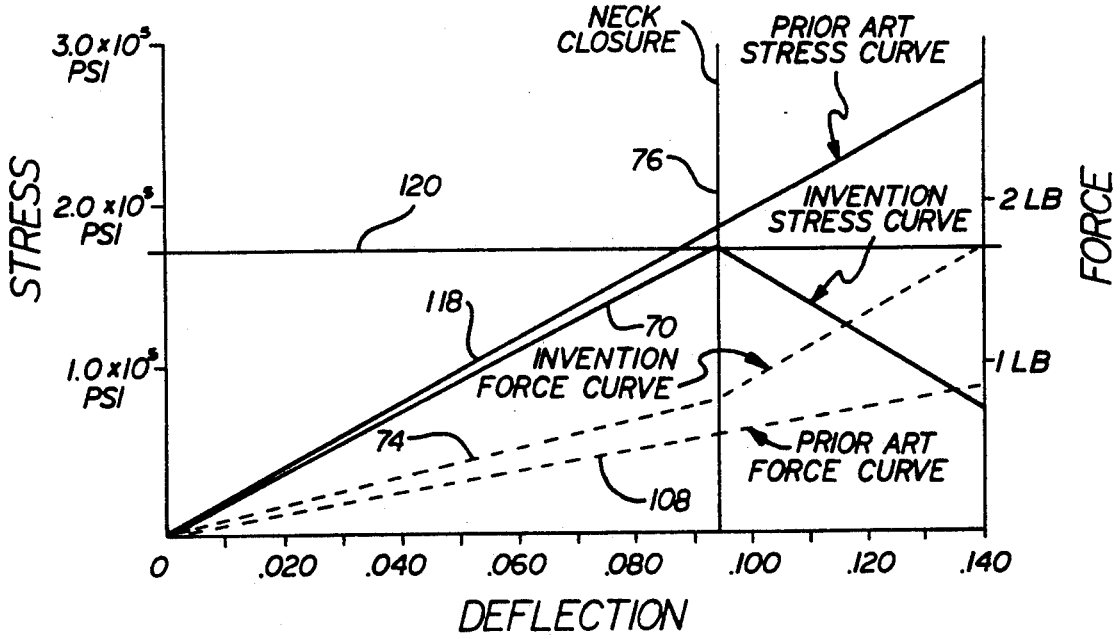

OVER-CENTER BIASING SPRING FOR PART CIRCLE GEAR DRIVEN ROTARY IRRIGATION SPRINKLERS

BACKGROUND OF THE INVENTION

This invention relates to part circle gear driven rotary irrigation sprinklers, and more particularly, to a new and improved biasing spring for biasing the gear train of such sprinklers into one or the other of two positions for rotating the sprinkler nozzle in the forward or reverse directions.

Part circle gear driven rotary sprinklers have long been known and used in the irrigation field. For example, the following United States Patents disclose such sprinklers and/or the drive mechanisms therefore: U.S. Pat. Nos. 3,107,056; 3,713,584; 3,724,757; 4,568,024; 4,708,291; 4,718,605; 4,901,924; 4,948,052; 4,955,542; and 5,086,977. The present invention relates specifically to a new and improved biasing spring usable with sprinklers of the types disclosed in the above-mentioned patents, the disclosures of which are incorporated herein by this reference.

While specific reference to these prior art patents can be made for details of construction for the design and operation of part circle, gear driven rotary sprinklers of the general types which the present invention is usable, such sprinklers typically include a generally cylindrical stationary housing within which is mounted a water driven motor, such as a water turbine or impeller, the output of which is directed to a reversing gear train drivingly coupled to a sprinkler nozzle rotatably mounted adjacent the upper end of the sprinkler housing. The reversing gear train operates to drive the sprinkler nozzle in alternating opposite rotary directions between preselected arcuate limits so as to irrigate a selected arcuate area around the sprinkler housing. Typically, the arcuate limits of nozzle rotation can be selected through the use of adjustable trip tabs which function to effect movement of the reversing gear train between a first position wherein the gear train drives the nozzle in a clockwise direction, and a second position wherein the gear train drives the nozzle in a counter clockwise direction.

The trip tabs engage a trip lever or arm rotatably supported by a trip collar mounted within the sprinkler housing, and the trip lever operates through a lost motion connection to engage a yoke plate forming a gear carrier support for the drive gear train. Shifting of the yoke by the trip lever causes the gear carrier to move between a first position where one terminal gear of the gear train engages a ring gear coupled to the sprinkler nozzle so that the nozzle is rotated in a clockwise direction, and a second position where another terminal gear of the gear train engages the ring gear to rotate the nozzle in the opposite, counter clockwise direction. To effect a snap-action of the yoke by the trip lever during sprinkler reversal, one or more over-center biasing springs are employed, typically acting between the trip collar and the sprinkler housing, as shown for example in U.S. Pat. Nos. 3,107,056 and 4,568,024, or between the trip collar and gear carrier, as shown for example in U.S. Pat. No. 4,955,542, or between the trip collar and housing and between the gear carrier and housing, as shown, for example in U.S. Pat. No. 4,718,605. In any case, the over-center biasing spring or springs act to convert the lost motion connection between the yoke and trip collar into a positive snap action of the gear carrier to bias and maintain one or the other of the terminal gears in driving relation with the ring gear.

As disclosed in the prior art patents mentioned above, the typical over-center biasing spring used with such sprinklers is formed from a generally flat, ribbon shaped metal, typically stainless steel, bent to have a shape generally like that of the Greek letter Nomegam with an arcuate head section and oppositely extending generally straight leg sections terminating in out turned ends, the out turned ends of each leg section being releasably engaged with a suitable seat which permits the spring end to pivot. Such springs are generally referred to as "omega springs." During a reversing operation, the spring seats are moved arcuately past each other causing one end of the omega spring to pivot past the other end. This causes the spring head and leg sections to deform and compress as the leg sections move toward each other, and once the leg sections have passed the over-center position, the stored energy of the compressed and deformed head and leg sections causes the leg sections to rapidly expand away from each other, thereby to effectively snap to the new extended position. For further details of this over-center snap action, reference can be made to the above mentioned patents.

During the normal life expectancy of a part circle gear driven sprinkler of the type with which this invention is primarily concerned, it is not uncommon that the reversing mechanisms may be required to operate several hundred thousand times. It has been found that with prior art omega springs of the aforementioned type, premature failure often occurs in the head section of the spring before the full life expectancy of the sprinkler has been reached. This can be attributed to spring metal fatigue caused by the cyclical stress experienced in the head section of the Omega spring during repeated deflections with prior art over-center Omega springs, much of the stress created during spring deflection is concentrated in the head section of the spring, with relatively lower stress levels occurring in the leg sections.

Another difficulty which has been found with such prior art biasing omega springs is that vibrations and shock loads sometimes found in pop-up type part circle gear driven sprinklers can cause the ends of the legs of the spring to disengage f rom their seats. In typical prior art Omega springs, the ends of the spring legs are provided with serrations and rely upon spring compression between the seats to maintain the spring in place by friction. As the repeated oscillations of the sprinkler fatigue the Omega spring, the frictional engagement of the spring legs against their seats decreases, thereby permitting the spring to become disengaged and render the sprinkler reversing mechanism inoperative. Further, during assembly of such prior art Omega springs, the spring must be manually compressed and installed in their seat. It is not uncommon that during installation, the prior art omega spring may be inadvertently overly compressed to a point at which permanent spring deformation occurs. This has also been found to reduce the useful life of the spring and result in premature spring failure.

Thus, there exists a need for an over-center biasing spring of the omega spring type for use with part circle gear driven sprinklers of the aforementioned general type and which will effectively eliminate premature spring failures and insure that the spring does not become disengaged from its spring seats during operation of the sprinkler over its full expected life. As will become more apparent hereinafter, the present invention has solved this need in a novel and unobvious manner.

SUMMARY OF THE INVENTION

In accordance with the present invention, an omega type spring is formed to more effectively distribute the internal stresses experienced during spring cycling in such a manner as to insure that cycle fatigue failure can not occur over the full expected life of a part circle gear driven sprinkler. Further, the Omega spring of the present invention provides increased stored energy as compared with prior art Omega springs, thereby to provide enhanced operation and reliability.

More specifically, the new and improved omega spring is formed from a ribbon-like strip of spring material, preferably stainless steel, to have a bulbous-shaped head section extending arcuately in a loop and interconnected with a pair of outwardly and downwardly diverging leg sections through a narrowed neck section forming a relatively small gap above the legs and below the head. Provision of the narrowed neck section results in a closure of the gap before the leg sections can abut as the spring is compressed so that further spring compression relieves the internal stress experienced in the head section. By selecting the size of the gap to close prior to a build up of stress in the head section to a level at which permanent deformation of the spring material can occur, cyclic fatigue failure of the spring can be avoided. Moreover, provision of the narrowed neck section prevents overstressing of the spring during assembly into a sprinkler thereby to further reduce the possibility of premature spring failure.

In accordance with another aspect of the present invention, the terminal ends leg sections of the Omega spring are provided with tabs which mate in cooperating openings formed in the spring seats so that the spring is securely retained and can not become dislodged by vibrations and shock loads experienced during sprinkler operations. The openings through the spring mounts are made to be oversized relative to the tabs to permit the terminal ends of the spring to pivot relative to the spring seats.

These and many other features and advantages of the present invention will become more apparent from the following detailed description taken in conjunction with the accompanying drawings which disclose, by way of example, the principles of the invention.

BRIEF DESCRIPTION OF THE DRAWINGS

FIG. 4 is an enlarged fragmenting sectional view taken substantially along the line 4—4 of FIG. 1;

FIG. 5 is a sectional view taken substantially along the line 5—5 of FIG. 4; and FIG. 6 is a graphical representation of the stress levels and forces generated by deflections of Omega springs of the type embodying the present invention as compared with those of the prior art;

DETAILED DESCRIPTION OF PRESENTLY PREFERRED EMBODIMENT

Figure 1:
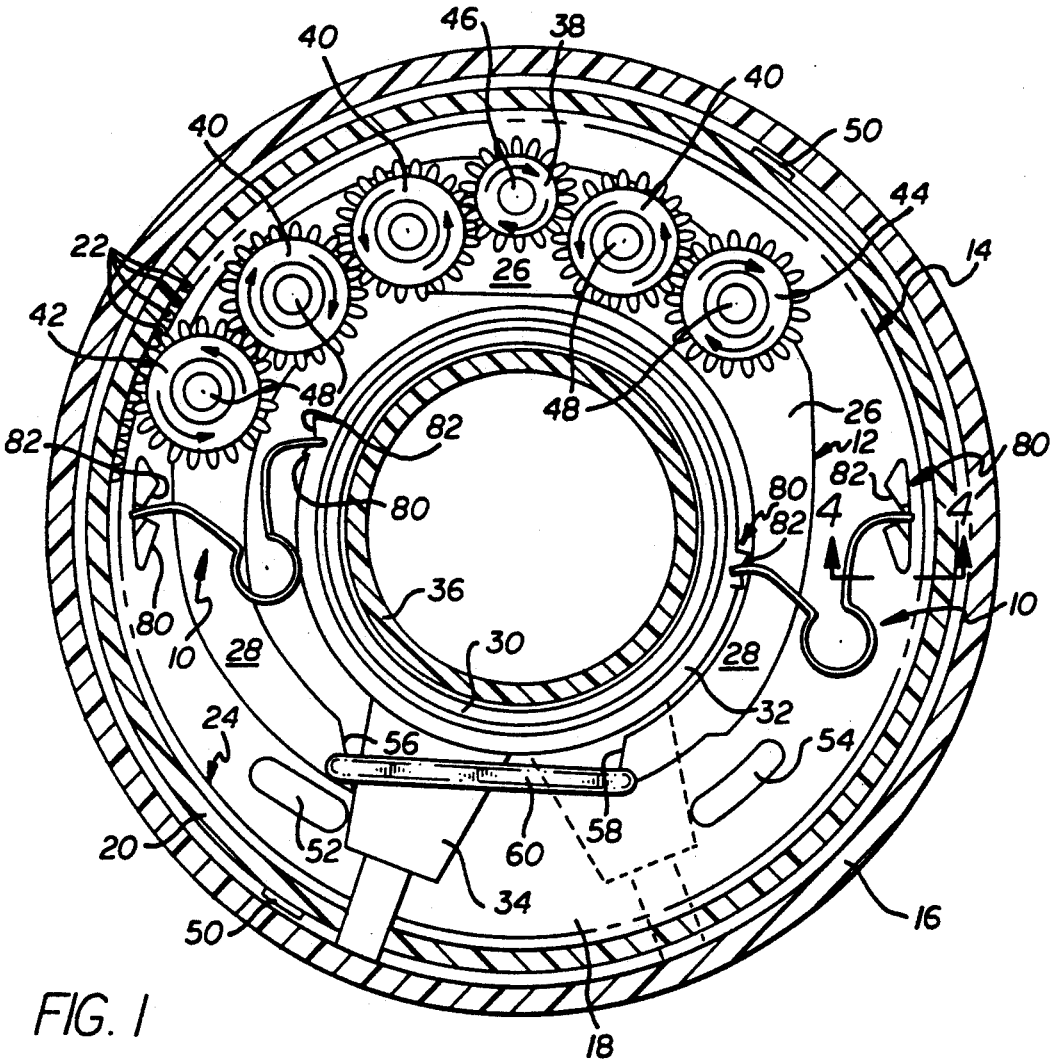
FIG. 1 is a top plan view, partially in cross-section, of a conventional reversing mechanism employed in a part circle gear driven rotary sprinkler and illustrating the new and improved omega type biasing springs of the present invention therein.

As shown in the exemplary drawings, the present invention is embodied in a new and improved over-center biasing spring 10 of the omega spring type primarily intended to be used in a part circle gear driven rotary sprinkler for biasing and maintaining the gear carrier support yoke 12 of a reversing gear mechanism 14 in one or the other of its two driving positions. In this instance, the reversing gear mechanism 14 illustrated in FIG. 1 is of the general type disclosed in the aforementioned U.S. Pat. No. 3,724,757, and includes a stationary, generally cylindrical outer housing 16 having a bottom horizontal wall 18, and within which is rotatably disposed an upstanding concentric cylindrical drive sleeve 20 having internal gear teeth 22 disposed around its lower end to form a ring gear 24. It will be appreciated that the drive sleeve 20 is, in turn, drivingly coupled to a sprinkler nozzle (not shown) disposed above the ring gear 24, and that these and other details of construction and operation not necessary for an understanding of the present invention have been omitted from the drawings for purposes of simplicity but can be found by a review of the aforementioned patents.

Still referring to FIG. 1, it can be seen that the yoke 12 of the reversing gear mechanism 14 herein comprises a generally flat sided, horseshoe-shaped plate having a central arcuate portion 26 with oppositely extending arcuate arm portions 28 partially encircling a stationary bearing sleeve 30 upstanding from the central portion of the bottom wall 18 of the housing 16. Disposed concentrically about the stationary sleeve 30 radially inwardly of the yoke 12 is a freely rotatable trip collar 32 having a radially outwardly projecting trip arm 34 extending therefrom. In this instance, a tubular shaft portion 36 forming part of the ring gear 24 is illustrated as disposed radially inwardly and concentrically positioned with respect to the stationary sleeve 30, the tubular shaft portion being integrally connected at its upper end to the drive sleeve 20 through a horizontally disposed disc shaped member (not shown) and forming a central support and mounting shaft for the drive sleeve.

For imparting rotary motion to the sprinkler nozzle through the drive sleeve 20, the reversing gear mechanism 14 includes a gear train supported on the central arcuate portion 26 of the yoke 12, and which herein comprises a fixed axis drive gear 38 drivingly engaged with idler pinion gears 40 disposed on opposite sides of the drive gear, and which are in turn drivingly engaged with terminal pinion gears 42 and 44. The drive gear 38 is secured to the end of a drive shaft 46 which projects downwardly through the yoke 12 and bottom wall 18 of the housing 16 where it is rotatably coupled with as suitable water operated drive motor (not shown) such as a turbine or impeller. The yoke 12 is rotatable relative to the drive shaft 46 which forms an axis about which the yoke can be pivoted. Each of the idler gears 40 and the terminal pinion gears 42 and 44 are supported for fee rotation on stub axles 48 coupled to the yoke 12 so that the pinion gears move with the yoke.

As shown in FIG. 1, on one side of the drive gear 38, herein the left side, there are two idler pinion gears 40 between drive gear and one terminal pinion gear 42, while on the opposite side of the drive gear, herein the right side, there is only one idler pinion gear. Thus, rotation of the drive gear 38 in the clockwise direction results in counterclockwise rotation of the terminal gear 42 on the left side of the drive gear in FIG. 1, and clockwise rotation of the terminal gear 44 on the right side, as indicated by the arrows. By pivoting the yoke 12 about the axis defined by the drive shaft 46, either the left side terminal pinion gear 42, or the right side terminal gear 44 can be brought into driving engagement with the ring gear 24, the left side terminal gear 42 being shown in FIG. 1 to be in the engaged position to rotate the ring gear and drive sleeve 20 in a counterclockwise direction.

To effect a reversal of the direction of rotation of the drive sleeve 20, the trip lever 34 is engageable by suitable trip tabs 50 carried with the drive sleeve, and which operate to deflect the trip lever and rotate the trip collar 32 about the stationary bearing sleeve 30 between two fixed stop abutments 52 and 54 upstanding from the bottom wall 18 of the housing 16. Movement of the trip lever 34 between the abutments 52 and 54 causes the lateral sides of the trip lever to engage the end faces 56 and 58 of the arcuate legs 28 of the yoke 12, and pivot the yoke about the drive shaft 46, the arcuate distance between the end faces being less than the arcuate distance between the abutments. Herein, a bridge arm 60 is shown interconnecting the terminal ends of the arcuate legs 28 and which extends above the trip lever 34 to prevent the trip lever from riding over the end faces 56 and 58 of the yoke 12.

As can further be observed from FIG. 1, as the drive sleeve 20 rotates counterclockwise and a trip tab 50 carried thereby engages the trip lever 34, the trip lever and trip collar 32 will be rotated about the stationary bearing sleeve 30 in a counterclockwise direction toward the phantom line position illustrated. Since the trip collar 32 is not coupled to the yoke 12, the trip lever 34 will not effect pivoting movement of the yoke until the side of the trip lever engages the end face 58 of the arcuate leg portion 28 shown at the right in FIG. 1. Thus, a lost motion connection is formed between the trip collar 32 and the yoke 12.

To effect the desired snap-action on reversal, Omega springs 10 of the present invention are shown in FIG. 1 herein disposed between the housing 16 and the trip collar 32. It should be noted that the precise location of the Omega springs 10 of the present invention is not important to the present invention since such omega springs can be positioned to act between other elements of the part circle gear driven sprinklers, as noted previously and disclosed in the aforementioned prior art patents.

In the embodiment shown in FIG. 1, it can be observed that as the trip lever 34 is engaged by the trip tab 50 and moved counterclockwise toward the phantom line position, the end of the Omega spring 10 mounted to the trip collar 32 will also be rotated counterclockwise, causing the spring end mounted to the trip collar to move past the opposite spring end which is mounted to the stationary housing 16. This relative movement of the spring ends causes the Omega spring 10 to compress and store energy until the spring end coupled to the trip collar 32 has passed the over-center position at which point the stored energy of the compressed spring causes the spring legs to be rapidly expanded away from each other, thereby snapping the trip lever 34 to the phantom line position against the abutment stop 54. Since the gap between the end faces 56 and 58 of the yoke 12 is less then the arcuate distance between the abutment stops 52 and 54, the side of the trip lever 34 will engage the end face 58 of the yoke before reaching the abutment stop 54, thereby causing the yoke to rapidly pivot about the axis of the drive shaft 4 6. This pivoting of the yoke 12 causes the terminal gear 42 of the gear train 14 to disengage from the ring gear 24 and moves the opposite terminal gear 44 into engagement with the teeth 24 of the ring gear, thereby to effect a reversal of the direction of rotation of the drive sleeve 20 from counterclockwise to clockwise, as shown in FIG. 1.

Figure 3:
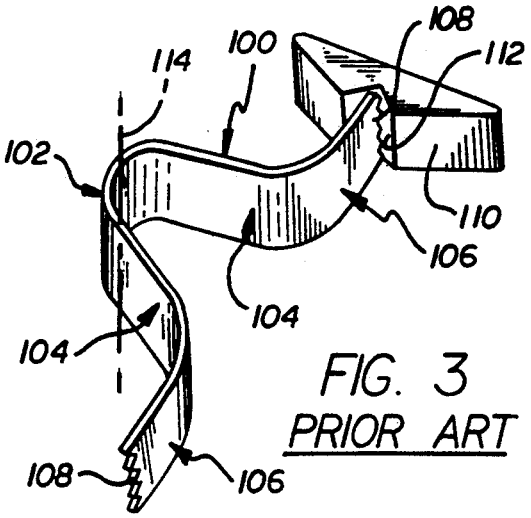
FIG. 3 PRIOR ART
FIG. 3 is an enlarged isolated perspective view of a typical prior art Omega type biasing spring.

Illustrated in FIG. 3 is a prior art omega type spring 100 typically used in sprinklers such as disclosed in the aforementioned patents. Such prior art Omega springs 100 are typically formed from a generally flat sided ribbon-like spring metal, such as stainless steel, and are shaped to include an arcuate head section 102 extending to downwardly and outwardly projecting generally straight leg sections 104 terminating in outwardly flared foot sections 106. Typically, the terminal ends of the foot sections 106 are provided with serrations 108 for frictionally engaging associated spring seats 110 (only one of which is shown in FIG. 3) appropriately mounted to the sprinkler reversing mechanism 14. Such spring seats 110 typically include a generally flat faced V-shaped notch 112 which permits the flared foot sections 106 of the legs 104 to pivot in the seat 110 as one end of the spring moves past the other during a reversing cycle. Normally, the prior art Omega springs 100 are installed in their seats 110 by manually deflecting and compressing the spring legs 104 together and sliding the foot portions 106 into the V-shaped notches 112. When installed, the Omega springs 100 are normally lightly preloaded between opposed seats 110 so that the serrations 108 maintain frictional engagement with the bases of the V-shaped notches 112.

It should be apparent that during a reversing cycle, as one leg 104 of the prior art Omega spring 100 moves toward the other, the legs are effectively squeezed and deflect toward each other until the center position is reached and terminal ends of the foot portions 106 are radially aligned directly opposite each other. As the trip collar 32 continues to move past the center position, the stored energy in the compressed spring 100 will cause the spring legs 104 to expand rapidly, thereby to effect a snap-action movement of the trip collar to the reverse position.

During the compression process, the prior art Omega spring 100 experiences a stress build up in the head section 102 with the maximum stress occurring along a plane of symmetry which extends through the mid point of the arcuate head section and bisects the spring into two mirror image halves. The line of intersection of this plane with the head section 102 of the prior art omega spring 100 is depicted in FIG. 3 by the reference numeral 114.

Graphically shown by the curve 118 in FIG. 6 is a representation of the internal stress experienced in the head section 102 along the line 114 in a typical prior art Omega spring 100 used in a part circle gear driven sprinkler. As can be seen, as the spring 100 is compressed, the stress level in the head portion 102 builds up in a linear manner until the spring reaches the center position with the terminal ends of the foot portions 106 radially aligned. At this point, the spring has reached its maximum compression. Typically, the spacing between the spring seats 110 is selected so that the center condition is reached just before the legs 104 abut, thereby to insure that the terminal ends of the foot portions 106 can freely pass each other without binding. In this instance, the exemplary prior art Omega spring 100 depicted in FIG. 6 was formed of a 0.125 inch wide stainless steel ribbon to have the general shape illustrated in FIG. 3, and having a material thickness of approximately 0.005 inch and a relaxed width from one serrated edge 108 of the outwardly flared foot section 106 to the other of approximately 0.385 inch. At maximum compression, the stress level experienced in the head portion was found to be approximately $2.8\times10^5$ pounds per square inch. As depicted by the curve 118, the stored spring force generated by the prior art omega spring 100 at maximum compression was found to be approximately 1.9 pounds.

Also depicted in FIG. 6 by the horizontal line 120 is the maximum desirable stress limit above which permanent deformation of the exemplary prior art Omega spring 100 will take place. As can be seen, for deflections of the spring 100 by deflection of the leg sections 104 toward each other above approximately 0.095 inches, permanent deformation occurs, and repeated cycling of the spring to compression levels exceeding this value will result in cyclic fatigue failure of the spring.

In accordance with a primary aspect of the present invention, the new and improved omega spring 10 is constructed to more effectively distribute the internal stresses experienced during spring cycling and actually reduce the stresses experienced by the arcuate head section of the spring, thereby to significantly reduce spring material fatigue and prevent premature spring failure over the full life of the associated part circle gear driven sprinkler. Further, the novel Omega spring 10 of the invention provides increased available stored energy over prior art Omega springs, thereby to provide enhanced operation and reliability.

Moreover, in accordance with another aspect of the present invention, a new and improved construction for mounting the Omega spring 10 has been provided which effectively prevents the spring from inadvertently becoming dislodged by vibrations and shock loads experienced during sprinkler operations. The construction of the Omega spring 10 of the invention additionally prevents inadvertent over stressing of the spring during assembly, a problem which has been encountered with prior art omega type springs and reduces their useful life.

Figure 2:
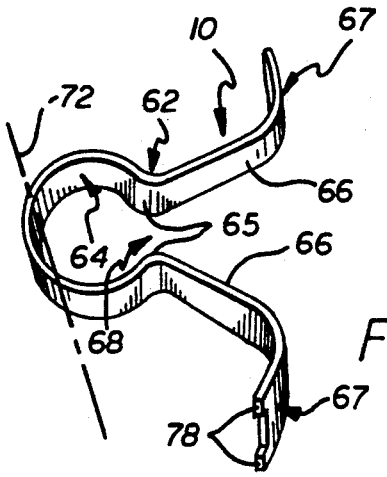
FIG. 2 is an enlarged isolated perspective view of an Omega type biasing spring of the type shown in FIG. 1 and embodying the principles of the invention.

Toward the foregoing ends, as best seen in FIG. 2, the omega type spring 10 of the present invention is constructed to form a narrowed neck section 62 interconnecting an arcuate head section 64 with downwardly and outwardly projecting leg sections 66 terminating in outwardly flared foot sections 67, so that a relatively small lateral gap 68 is formed between opposed sides of the spring. More specifically, the omega spring 10 has a generally rectangular lateral cross-section, and is herein formed from a ribbon-like elongated strip of flat sided spring material, preferably stainless steel, to have a bulbous-shaped head section 64 extending arcuately in a loop between opposed end portions leading to the neck sections 62 defined by reverse curved wall sections 65 interconnecting the head section with the leg sections 66 so that the legs laterally diverge from each other below the neck sections. The gap 68 is thus defined by the width of the space between the interior opposed sides of the reverse curved wall sections 65 interconnecting the head section 64 with the leg sections 66.

It has been found that by forming the neck section 62 so that the gap 68 is smaller than the minimum lateral distance between the leg sections 66, as the legs 66 of the Omega spring 10 are deflected toward each other, the opposed sides of the neck section will abut so that further spring compression occurs by deflection of the leg sections alone. This further compression causes the abutting wall portions 65 of the neck sections 62 to act as a pivot, thereby tending to actually reduce the internal stress of the head section 64. That is, as the leg sections 66 of the Omega spring 10 continue to be deflected toward each other after the opposed sides of the spring in the region of the neck 62 have come into contact, the head section 64 above the neck will undergo an expansive internal force, thereby relieving the stress created during the initial spring compression up to the point of closure of the gap 68.

Moreover, by maintaining the gap 68 in the region of the neck 62 small enough to be closed before the internal stress of the Omega spring 10 experienced in the head section 64 reaches the maximum stress level at which permanent deformation occurs, as represented, for example by the line 120 in FIG. 6, the stress build up within the Omega spring 10 of the invention can be maintained well below that at which permanent spring deformation can occur, thereby to prevent cyclic fatigue failure. In the example graphically depicted in FIG. 6, an Onega spring 10 was constructed from the same materials as that of the prior art Omega spring 100 in the example discussed above, and was configured to have the same general shape as that illustrated in FIG. 2 with a gap 68 of approximately 0.045 inches in the region of the neck 62 and a relaxed width between the outer ends of the foot portions 67 of approximately 0.385 inches. As depicted by the curve 70 in FIG. 6, it was found that a reduction in the stress level within the head section 64 as experienced along the imaginary line 72 representing the intersection of a bisecting plane like that forming the line 114 in FIG. 3, occurred after a total spring deflection of approximately 0.094 inches was reached and the gap 68 closed.

Moreover, it was found that the stress level within the head section 64 of the Omega spring 10 continued to reduce after closure of the gap 68 while the stored energy within the spring actually increased at a greater rate, as depicted by the broken line curve 74 in FIG. 6. Thus, the Omega spring 10 of the present invention not only reduced stress within the head section 64 of the spring and kept that stress below the maximum stress level depicted by the curve 120, but surprisingly also increased the stored energy available over the stored energy available in the prior art omega spring 100. It is believed that the increased spring force is created as a result of the effective spring length being reduced at neck closure. That is, during initial deflection prior to closure of the gap 68, the effective length of the spring 10 is from the end of the foot portion 67 to the mid point of the head section 64, but after closure of the gap, the length is reduced to only the distance to the point of contact of the opposed sides in the region of the neck 62.

It should also be appreciated that creation of the neck section 62 prevents the possibility of the Omega spring 10 of the invention f rom inadvertently being over stressed during assembly. That is, unlike the prior art omega spring 100 which can be compressed to a level above the maximum stress level, the omega spring 10 of the invention can not be stressed to such a high level during assembly compression since the gap 68 will close before the stress level at which permanent deformation occurs is reached. This further reduces the possibility of premature failure of the Omega spring 10.

As best seen in FIGS. 2, 4 and 5, the foot sections 67 of the omega spring 10 are provided with longitudinally extending spaced tabs 78 which act to releasably yet securely hold the Omega spring to modified spring seats 80. Like the spring seats 110 depicted in FIG. 3, the modified spring seats 80 include generally V-shaped notches 82 to permit the foot sections 67 to pivot during reversing operations, but are also provided with spaced openings 84 adapted and arranged to receive the spaced tabs 78. Insertion of the tabs 78 into the openings 84 prevent the foot sections 67 of the Omega spring 10 from being jarred loose from the spring seats 80 so that vibrations and shock loads experienced during sprinkler operation can not dislodge the Omega spring and render the reversing mechanism 14 inoperative. Notably, the openings 84 are oversized relative to the height and width of the tabs 78, thereby to permit the tabs to pivot within the openings as the foot sections 67 pivot within the V-shaped notches 82 of the modified seats 80.

From the foregoing, it should be appreciated that the Omega spring 10 of the present invention provides a spring structure which reduces the possibility of premature spring failure due to cyclic stress when used in a part circle gear driven rotary irrigation sprinkler. Moreover, the omega spring 10 provides increased available stored energy over prior art Omega springs, a factor of considerable importance due to the very limited amount of space available for installing and mounting biasing springs in part circle gear driven sprinklers typically found on the commercial market. With the Omega spring 10 of the invention, assembly into the sprinkler is less critical since the spring material can not be overstressed, and the spring can be securely mounted so that it can not become inadvertently dislodged during sprinkler use.

While a particular form of the invention has been illustrated and described, it will be apparent that various modifications can be made without departing from the spirit and scope of the invention.

What is claimed is:

1. An improved part circle gear drive rotary sprinkler of the type including a drive gear train supported by a gear carrier movable between a first drive position and a second drive position for effecting rotation of the sprinkler in opposite rotary directions, and a lost motion trip mechanism for causing said gear carrier to be moved between said first and second positions, at least one over-center biasing means mounted to said sprinkler for biasing and maintaining said gear carrier in either of said first and second positions, wherein the improvement comprises:

said over-center biasing means comprising an elongated strip of spring material formed to have a bulbous-shaped arcuate head section interconnected through a narrowed neck section with downwardly and outwardly diverging leg sections, said narrowed neck section being formed to reverse curved arcuate wall sections to define a gap therebetween above said leg sections and below said head section, said leg sections terminating in outwardly flared foot sections adapted for mounting said biasing means to said sprinkler.

2. The improvement as set forth in claim 1 wherein said spring material is stainless steel.

3. The improvement as set forth in claim 1 wherein said sprinkler includes spaced spring mounts adapted and arranged to receive said foot sections for mounting said biasing means to said sprinkler, said spaced spring mounts each being formed to permit said foot section received therein to pivot relative to said spring mount.

4. The improvement as set forth in claim 3 wherein said foot sections each include at least one outwardly projecting tab and said spring mounts each include at least one opening adapted to receive said tab, whereby insertion of said tab into said opening securely mounts said foot section to said spring mount.

5. The improvement as set forth in claim 4 wherein each of said spring mounts includes a generally V-shaped notch within which said foot section is received, said V-shaped notch being formed to permit said foot section received therein to pivot relative to said spring mount.

6. The improvement as set forth in claim 5 wherein said spring material is stainless steel.

7. An improved part circle irrigation sprinkler of the type including a reversing drive mechanism movable between first and second alternate positions for rotating a sprinkler nozzle in opposite directions, and at least one over-center biasing means for biasing and maintaining said reversing drive mechanism in one or the other of said first and second alternate positions, wherein said improvement comprises:

each of said biasing means comprising a strip of spring material formed to include a generally bulbous-shaped head section extending arcuately in a loop between opposed end portions, a pair of laterally diverging leg sections projecting from said head section, and a neck section interconnecting said head section and said leg sections, said neck section being formed by a pair of oppositely curved arcuate wall portions, each extending between one of said end portions and one of said leg sections thereby to form a lateral gap therebetween, said lateral gap having a width less than the minimum lateral distance between said leg sections, whereby upon deflection of said leg sections towards each other, said gap will close before said leg sections below said neck section come into abutting contact.

8. The improvement as set forth in claim 7 wherein said reversing mechanism includes spaced mounting means for receiving and mounting said strip of spring material thereto, and each of said leg sections terminates in a laterally outwardly flared foot section adapted to be received by said mounting means.

9. The improvement as set forth in claim 8 wherein each of said foot sections includes an outwardly projecting tab and each of said mounting means includes an opening for loosely receiving said tab.

10. The improvement as set forth in claim 9 wherein said strip of spring material comprises a strip of stainless steel having a generally rectangular lateral cross-section.

* * * * *